US009718203B2

(12) United States Patent
Bucks

(10) Patent No.: US 9,718,203 B2
(45) Date of Patent: Aug. 1, 2017

(54) CUTTING HEAD ASSEMBLY FOR A CENTRIFUGAL CUTTING APPARATUS AND CENTRIFUGAL APPARATUS EQUIPPED WITH SAME

(71) Applicant: FAM, Kontich (BE)

(72) Inventor: Brent Bucks, Lakewood Ranch, FL (US)

(73) Assignee: FAM, Kontich (BE)

( * ) Notice: Subject to any disclaimer, the term of this patent is extended or adjusted under 35 U.S.C. 154(b) by 0 days.

(21) Appl. No.: 14/643,737

(22) Filed: Mar. 10, 2015

(65) Prior Publication Data

US 2016/0075047 A1 Mar. 17, 2016

(30) Foreign Application Priority Data

Mar. 10, 2014 (EP) ..... 14158618

(51) Int. Cl.
*B26D 7/06* (2006.01)
*B26D 7/26* (2006.01)
*B26D 1/03* (2006.01)

(52) U.S. Cl.
CPC ..... *B26D 7/2614* (2013.01); *B26D 1/03* (2013.01); *B26D 7/0691* (2013.01); *B26D 7/2628* (2013.01)

(58) Field of Classification Search
CPC ..... B26D 7/2614; B26D 7/0691; B26D 1/03; B26D 7/2628
USPC ..... 83/404.3, 856, 857, 403, 698.11, 698.41, 83/699.51, 356.3
See application file for complete search history.

(56) References Cited

U.S. PATENT DOCUMENTS 2,195,879 A 4/1940 Urschel et al.
2,875,800 A 3/1959 Urschel
3,139,128 A * 6/1964 Urschel ..... B26D 1/0006 83/111
3,196,916 A 7/1965 Urschel
(Continued)

OTHER PUBLICATIONS

Brunner-Anliker product info on the IR 250 Industrial Food Processor, available at brunner-anliker.com, 6 pages, © Jul. 23, 2002.
(Continued)

*Primary Examiner* — Omar Flores Sanchez
(74) *Attorney, Agent, or Firm* — Koppel, Patrick, Heybl & Philpott

(57) ABSTRACT

The present invention relates to a cutting head assembly (100) for a centrifugal cutting apparatus. The cutting head assembly (100) comprises a plurality of cutting stations (101) each provided with a cutting element (104, 204) for cutting or reducing food products. The cutting stations (101) being separately mounted adjacent one another on a rim structure (102, 202, 302, 402). The cutting head assembly (100) further comprising fixing elements (103, 203) for securing the cutting stations (101) to the rim structure (102, 202) and a first set of gap setting elements (105, 205, 305) arranged for adjusting the position of the rear edge of the cutting stations (101) with respect to the front edge of the cutting elements (104, 204) of adjacent cutting stations (101). The gap setting elements (105, 205, 305) being arranged for adjusting the position of the rear edge of the cutting stations (101) with respect to the rim structure (102, 202, 302, 402).

14 Claims, 12 Drawing Sheets

(56) References Cited

U.S. PATENT DOCUMENTS

| | | | | | |
|---|---|---|---|---|---|
| 3,302,676 | A | * | 2/1967 | Wright | B26D 1/03 241/275 |
| 3,823,880 | A | | 7/1974 | Urschel | |
| 3,888,426 | A | | 6/1975 | Urschel et al. | |
| 3,989,196 | A | | 11/1976 | Urschel | |
| 4,042,183 | A | | 8/1977 | Cumpston | |
| 4,523,503 | A | | 6/1985 | Julian et al. | |
| 4,604,925 | A | | 8/1986 | Wisdom | |
| 4,610,397 | A | | 9/1986 | Fischer et al. | |
| 4,937,084 | A | * | 6/1990 | Julian | B26D 1/03 426/144 |
| 5,249,494 | A | * | 10/1993 | Borvitz | B26D 3/18 83/302 |
| 7,270,040 | B2 | | 9/2007 | King et al. | |
| 2004/0216572 | A1 | | 11/2004 | King | |
| 2004/0237747 | A1 | | 12/2004 | King | |
| 2007/0240550 | A1 | | 10/2007 | Jacko | |
| 2008/0022822 | A1 | | 1/2008 | Jacko et al. | |
| 2009/0202694 | A1 | | 8/2009 | Julian et al. | |
| 2013/0276604 | A1 | | 10/2013 | King et al. | |
| 2014/0007751 | A1 | | 1/2014 | Michel et al. | |

OTHER PUBLICATIONS

Brunner-Anliker technical data on the IR 250 Industrial Food Processor. available at brunner-anliker.com, 1 page, © Jul. 23, 2002.
Brunner-Anliker color technical data on the IR-250 Industrial Food Processor, available at brunner-anliker.com, one page, © Jul. 23, 2002.
European Search Report for EP14158618.0 dated Sep. 2, 2014.

* cited by examiner

CUTTING HEAD ASSEMBLY FOR A CENTRIFUGAL CUTTING APPARATUS AND CENTRIFUGAL APPARATUS EQUIPPED WITH SAME

TECHNICAL FIELD

The present invention relates to a cutting head assembly for a centrifugal cutting apparatus. The present invention further relates to a centrifugal cutting apparatus equipped with such a cutting head assembly, such as for example a food cutting apparatus.

BACKGROUND ART

A centrifugal cutting apparatus comprises an impeller which is arranged to rotate concentrically within a cutting head so as to impart a centrifugal force to the food products to be cut. The cutting head is normally an assembly of a plurality of cutting stations, also referred to as shoes, each provided with a cutting element arranged for cutting or reducing the food product concentrically rotating in the cutting head.

A centrifugal cutting apparatus is for example known from the U.S. Pat. No. 7,270,040.

DISCLOSURE OF THE INVENTION

It is an aim of the present invention to provide an improved cutting head assembly for a centrifugal cutting apparatus.

This aim is achieved according to the invention with the cutting head assembly showing the technical characteristics of the characterising part of the first claim.

More in particular, according to a first aspect of the present invention, a cutting head assembly for a centrifugal cutting apparatus is provided. The cutting head assembly comprises a plurality of cutting stations each provided at a front edge with a cutting element for cutting or reducing food products. The cutting stations are arranged to be separately (individually) mounted on the rim structure such that a gap is formed between a front edge of the cutting element and a rear edge of an adjacent cutting station. Through this gap, the cut or reduced food products can exit the cutting head where they can be collected and further processed. The cutting head assembly may further comprise fixing elements arranged for securing the cutting stations to the rim structure at predetermined locations. For example, the fixing elements may comprise bolts arranged to cooperate with matching bores provided on the cutting stations and the rim structure. Preferably the cutting stations are secured on the inside diameter of the rim structure. The cutting head assembly may further comprise a first set of gap setting elements arranged for adjusting the position of the rear edge of the cutting stations with respect to the front edge of the adjacent cutting elements, thereby adjusting the slice thickness setting of the cutting head assembly that determines the thickness of the cut or reduced food products. According to the present invention, the first set of gap setting elements are arranged for adjusting the slice thickness settings of the cutting head assembly by adjusting the position of the rear edge of the cutting stations with respect to the rim structure. This means that the gap between adjacent cutting stations may be set by adjusting the position of the rear edge without altering the position of the front edge.

It has been found that adjusting the position of the rear edge of the cutting stations with respect to the rim structure rather than the position of the front edge of the cutting element with respect to the rim structure may have as an advantage that the clearance of the front edge of the cutting element from the impeller, which rotates inside the cutting head to urge products to be cut towards the cutting elements by centrifugal force, may remain constant irrespective of the slice thickness setting of the cutting head assembly. It has been found that keeping the clearance of the front edge of the cutting element constant from the impeller and adjusting the slice thickness setting at the rear edge of the cutting stations, a much wider range of possible slice thickness settings can be handled by means of the same cutting head. This means that a user can handle a wider range of possible cuts with the same cutting head assembly than in the prior art, so needs to purchase or stock fewer cutting heads or parts thereof to be able to cover the desired range. Furthermore, adjusting the slice thickness setting of the cutting head assembly from the rear edge, may have as an advantage over the prior art that damages to the cutting head assembly due to incorrectly positioning the cutting element with respect to the impeller can be avoided.

According to embodiments of the present invention, the first set of gap setting elements may be provided at predetermined locations between the rear edges of the cutting stations and the rim structure. This arrangement may ensure that the first set of gap setting elements are securely held into the desired position by the opposing surfaces of the cutting stations and the rim structure, thereby significantly reducing the chances of a gap setting element becoming loose during operation of the cutting head. This arrangement may further ensure that even in the case where a gap setting element becomes loose during operation it will be directed to the outside of the cutting head assembly rather on the inside where the food products are rotated. As a result, damage to the cutting elements or other parts of the cutting head assembly, due to the loose gap setting element freely rotating in the cutting head assembly, can be avoided. Moreover, this arrangement may further offer the advantage that the shape of the first set of gap setting elements may be independent from the shape of the inner surface of the cutting station, which is in contact with the food products rotating in the cutting head. This means that a user may use the same type of gap setting elements irrespective of the shape of the inner surface of the cutting station, thereby significantly reducing the number of different types of spare parts required for setting the slice thickness of the cutting head assembly. For example, flat shaped gap setting elements may be used with a cutting station having elongated grooves on the inside surface.

According to embodiments of the present invention, the first set of gap setting elements may be provided at the locations of the fixing elements at the rear edges of the cutting stations. As a result, the first set of gap setting elements may be secured at the desired locations with the same fixing elements that are used for mounting the cutting stations to the rim structure. This may have as an advantage that no extra fixing elements are required, which may contribute in the reduction of the time taken for assembling the cutting head with the correct slice thickness settings for cutting or reducing the food products.

According to embodiments of the present invention, the first set of gap setting elements provided at the rear edge of the cutting stations may comprise exchangeable gap setting elements of different thicknesses. For quickly adjusting the position of the rear edges of the cutting stations with respect to the rim structure, the first set of gap setting elements may be provided with a recess such that they may be slotted into the location of the fixing elements. Furthermore, the first set of gap setting elements may be provided with an opening for inserting a tool, e.g. screw driver, arranged for applying a pulling force on the gap setting elements such that the gap setting elements may be removed from the location of the fixing elements without the need for completely removing the cutting station from the rim structure. As a result, the position of the rear edge of the cutting stations with respect to the rim structure may be easily adjusted even while the cutting stations remain mounted on the rim structure. Depending on the food products to be cut or reduced the first set of gap setting elements may be used to adjust the position of the rear edge of the cutting stations from the rim structure in the range from 0.0 mm to 50 mm, more preferably in the range from 0.0 mm to 20.0 mm, even more preferably in the range from 0.0 mm to 10.0 mm. For example, in the case where the food product is potatoes the rear edge of the cutting stations may be positioned with respect to the rim structure at a distance in the range from 0.0 mm to 10.0 mm. In a different example, when the food product is lettuce, the position of the rear edge of the cutting stations may be adjusted with respect to the rim structure in the range from 0.0 mm to 50.0 mm. To achieve this adjustment range, gap setting elements of predetermined thicknesses may be provided. For example, the thickness of the first set of gap setting elements may vary in increments of at least 0.01 mm, at most 10.0 mm, more preferably at most 1.0 mm, more preferably at most 0.1 mm, and even more preferably at most 0.05 mm. According to embodiments of the present invention, the position of the rear edge of the cutting stations with respect to the rim structure may be adjusted by using a combination of gap setting elements of different thicknesses.

According to embodiments of the present invention, the cutting head assembly may further comprise a second set of gap setting elements arranged for setting the position of the front edge of the cutting stations with respect to the rim structure. In other words, further gap setting elements may be provided at the front edge of the cutting stations for adjusting the distance of the front edge of the cutting stations from the rim structure. The second set of gap setting elements may be provided at the locations of the fixing elements at the front edge of the cutting stations and may be used for compensating manufacturing tolerances, i.e. to correct any manufacturing errors occurred due to the accuracy limitations of the manufacturing tools used for manufacturing the cutting stations. These manufacturing errors may severely affect the alignment of the cutting element positioned at the front edge of the cutting stations, which may lead to poorly cut or reduced food products if not appropriately corrected. According to embodiments of the present invention, the position of the front edge of the cutting element may be arranged to remain constant irrespective of the slice thickness settings of the cutting head. Therefore, the second gap setting elements may be arranged so that they remain fixed at the desired locations while the cutting stations are attached to the rim structure. According to embodiments of the present invention, each of the gap setting elements of the second set may be provided with a predetermined thickness, which corresponds to the manufacturing tolerances detected. For example, in the case where the manufacturing error is greater at the bottom of the rear edge of the cutting station than at the top, a second set of gap setting elements having different thicknesses may be positioned at the top and bottom of the rear edge of the cutting station. In another example, when the manufacturing error is the same at both top and bottom locations of the rear edge, a second set of gap setting elements having identical thicknesses may be used.

According to embodiments of the present invention, the first set of gap setting elements for setting the position of the rear edges of the cutting stations may have different shape from the second set of gap setting elements arranged for setting the position of the front edges of the cutting stations. For example, the second set of gap setting elements may be provided with a hole, through which the fixing elements may enter, while the first set of gap setting elements may be provided with a recess. As a result, the user may easily distinguish which of the gap setting elements correspond to the rear and front edges of the cutting stations. Alternatively, the first and second sets may also comprise at least partly the same gap setting elements, i.e. gap setting elements which are usable at the front as well as the rear edges of the cutting stations. According to embodiments of the present invention, the gap setting elements provided at each of the fixing elements locations may be of different thicknesses.

According to embodiments of the present invention, the cutting stations may be provided with elongated grooves on the inside of the cutting head assembly, which may span more than half the length of the cutting station. The elongated grooves may be arranged for providing relief from stones or other debris entering the cutting head along with the food products to be cut or reduced. Furthermore, the elongated grooves may be arranged for guiding the food products along a predetermine path towards the cutting elements, thereby ensuring that the product is cut or reduced according to a specific shape. The elongated grooves may further be aligned to the shape of the front edge of the cutting elements. For example, when the cutting station is provided with a corrugated shape cutting element, the peaks and valleys of the elongated grooves may be aligned to the peaks and valleys of the corrugated shaped cutting element.

According to embodiments of the present invention, the rim structure in addition to function as a support element for mounting the cutting stations may further function as a sizing element for determining the size of the cutting head. Furthermore, it has been found that the diameter of the rim structure may influence the adjustment range of the slice thickness of the cutting head assembly. Therefore, a larger diameter rim structure may significantly increase the adjustment range of the slice thickness setting of the cutting head assembly without the need for providing different cutting stations. For example, in the case of slicing food products, such as lettuce, a larger diameter rim structure may be used for achieving an adjustment range from 0.0 mm to 50.0 mm without the need for providing different cutting stations. As a result, the number of parts required for cutting or reducing different food products may be significantly reduced.

According to embodiments of the present invention, the rim structure may comprise a number of bores positioned at different levels such that the cutting stations can be mounted in different configurations. For example, the cutting stations may be mounted so that cutting elements of adjacent cutting stations are aligned with one another. This configuration may be used for example with corrugated or flat shaped cutting elements to produce sliced food products having an identical shape on both sides. In a different configuration, alternating cutting stations may be mounted at different levels such that the cutting elements of adjacent cutting stations are phase shifted. This configuration may be used for example with corrugated shaped cutting elements to shred food products or for producing sliced food products with different shapes on each side.

According to a second aspect of the present invention, a cutting station may be provided for use with the cutting head assembly of the first aspect of the present invention. The cutting station may comprise means for receiving a cutting element at a front edge of the cutting station for cutting or reducing food products. The cutting station may further comprise a first surface located at the rear edge of the cutting station and a second surface located at the front edge of the cutting station. The first and second surfaces are arranged for facing the inside diameter of a rim structure when the cutting station is mounted on the rim structure. The cutting station may be separately mounted adjacent other cutting stations on the rim structure such that a gap is formed between a front edge of the cutting element and a rear edge of an adjacent cutting station through which the cut or reduced food products can exit the cutting head. Fixing elements may be further provided for securing the cutting element on the front edge of the cutting station. According to embodiments of the present invention, the first surface of the cutting station may be arranged for receiving a first set of gap setting elements arranged for adjusting the position of the rear edge of the cutting station with respect to the rim structure so as to adjust the position of the rear edge of the cutting station with respect to the front edge of the cutting element of adjacent cutting stations.

According to embodiments of the present invention, the second surface of the cutting station located at the front edge of the cutting station may be arranged for receiving a second set of gap setting elements. The second set of gap setting elements may be used for adjusting the position of the front edge of the cutting station with respect to the rim structure. For example, the second set of gap setting elements may be used for compensating the manufacturing tolerances of the cutting station.

According to embodiments of the present invention, the first and/or second surfaces of the cutting station may be complementary to the inner shape of the rim structure, e.g. may have a curvature corresponding to the curvature of the inside surface of the rim structure.

According to embodiments of the present invention, a centrifugal cutting apparatus may be provided comprising a cutting head assembly according to embodiments of the first aspect of the present invention for cutting food products. The cutting head assembly may comprise a cutting station according to embodiments of the second aspect of the present invention.

BRIEF DESCRIPTION OF THE DRAWINGS

The invention will be further elucidated by means of the following description and the appended figures.

MODES FOR CARRYING OUT THE INVENTION

Figure 1:
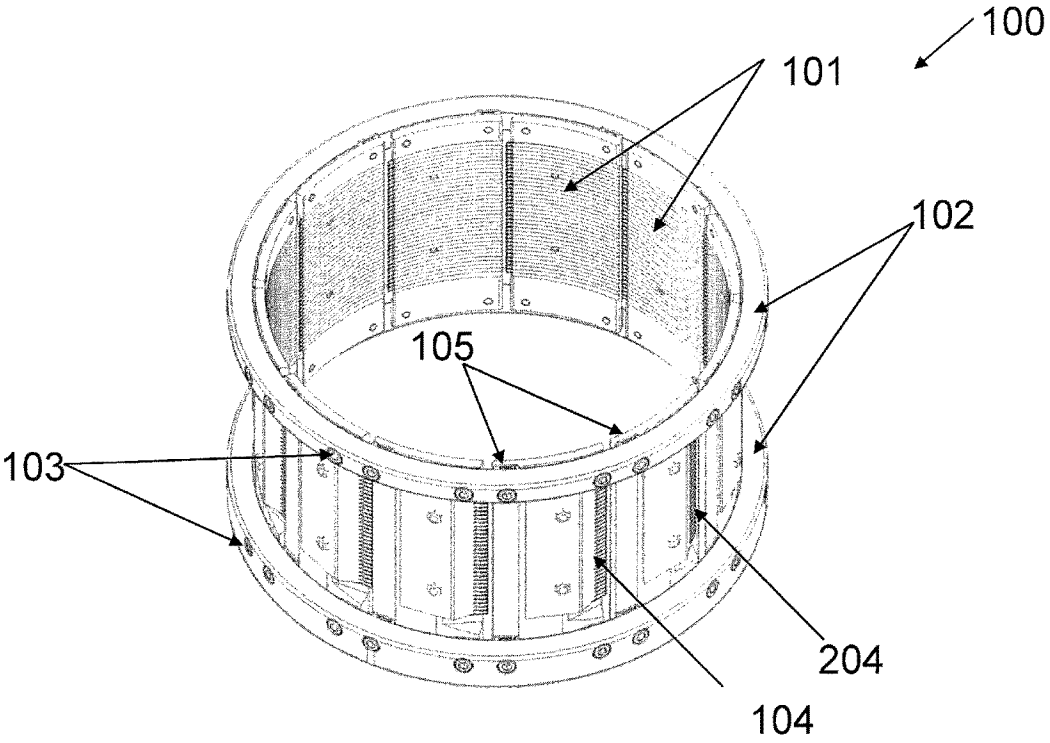
FIG. 1 shows a perspective view of an assembled cutting head according to embodiments of the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

The term "comprising", used in the claims, should not be interpreted as being restricted to the means listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

As used herein, the term "separately mounted" or "individually mounted" used to describe the mounting of the cutting stations on the rim structure may be interpreted as meaning that adjacent cutting stations do not have any overlapping parts.

Figure 5:
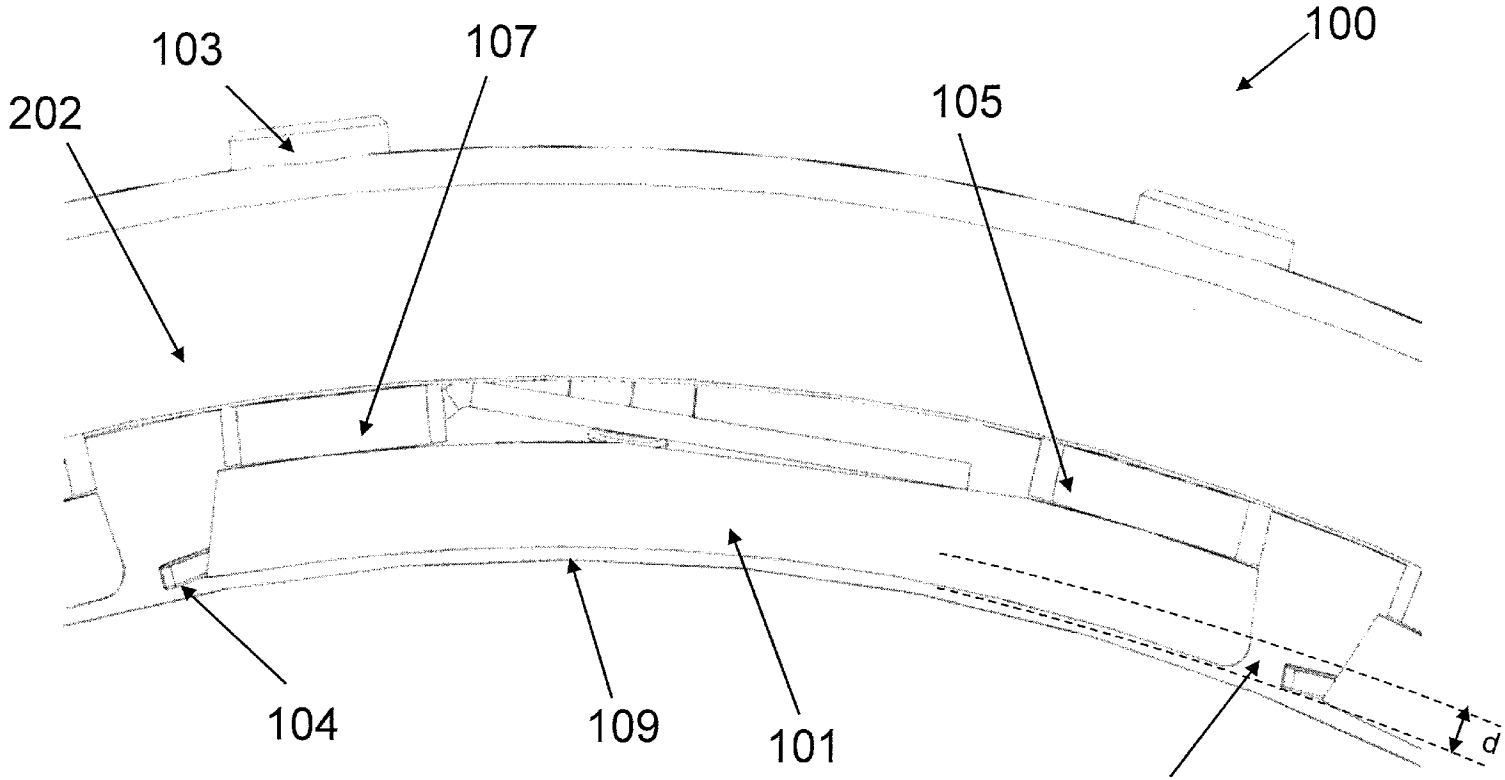
FIGS. 5 to 7 show different top views of a cutting head assembly according to embodiments of the present invention.
Figure 6:
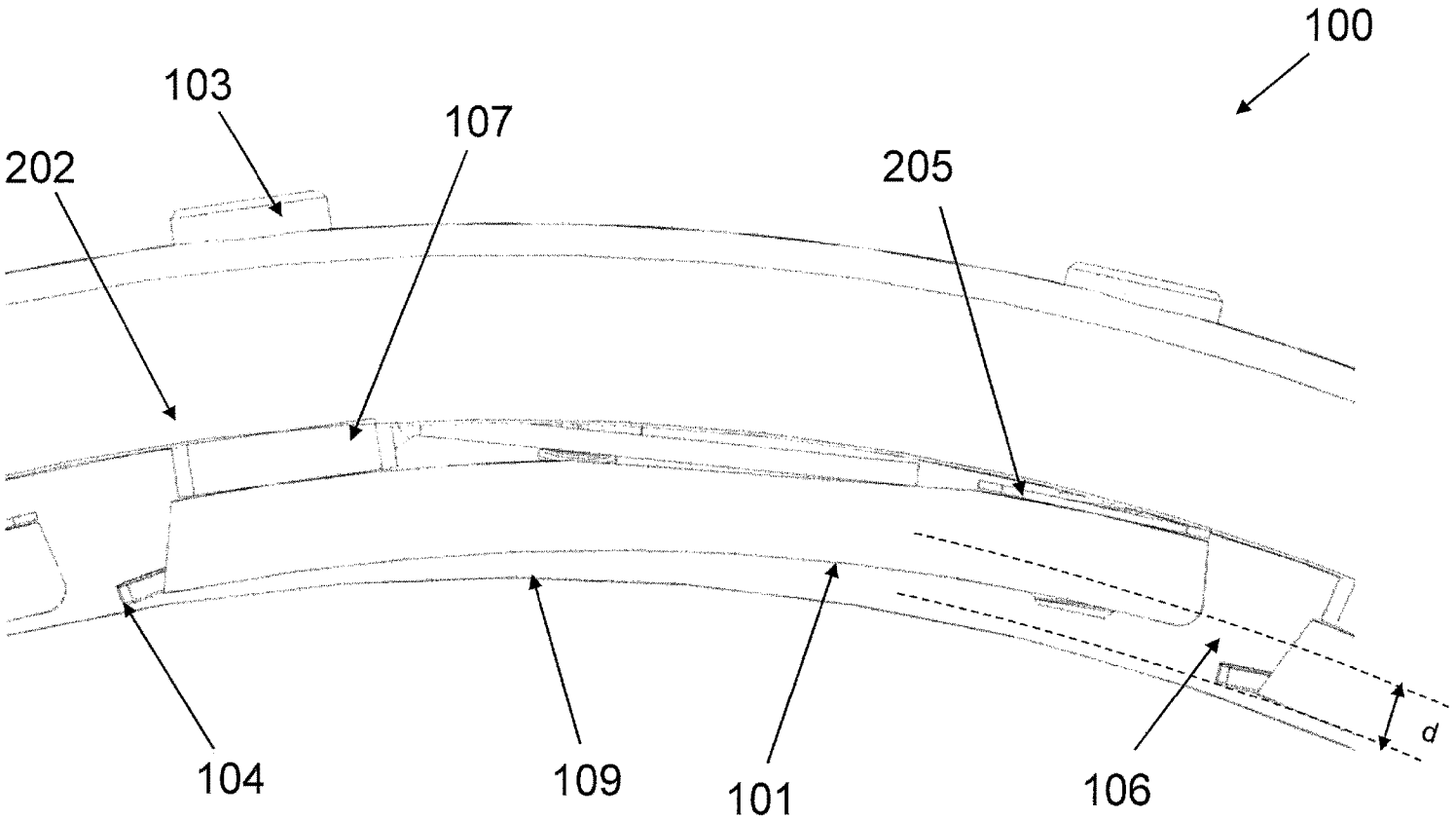
Figure 7:
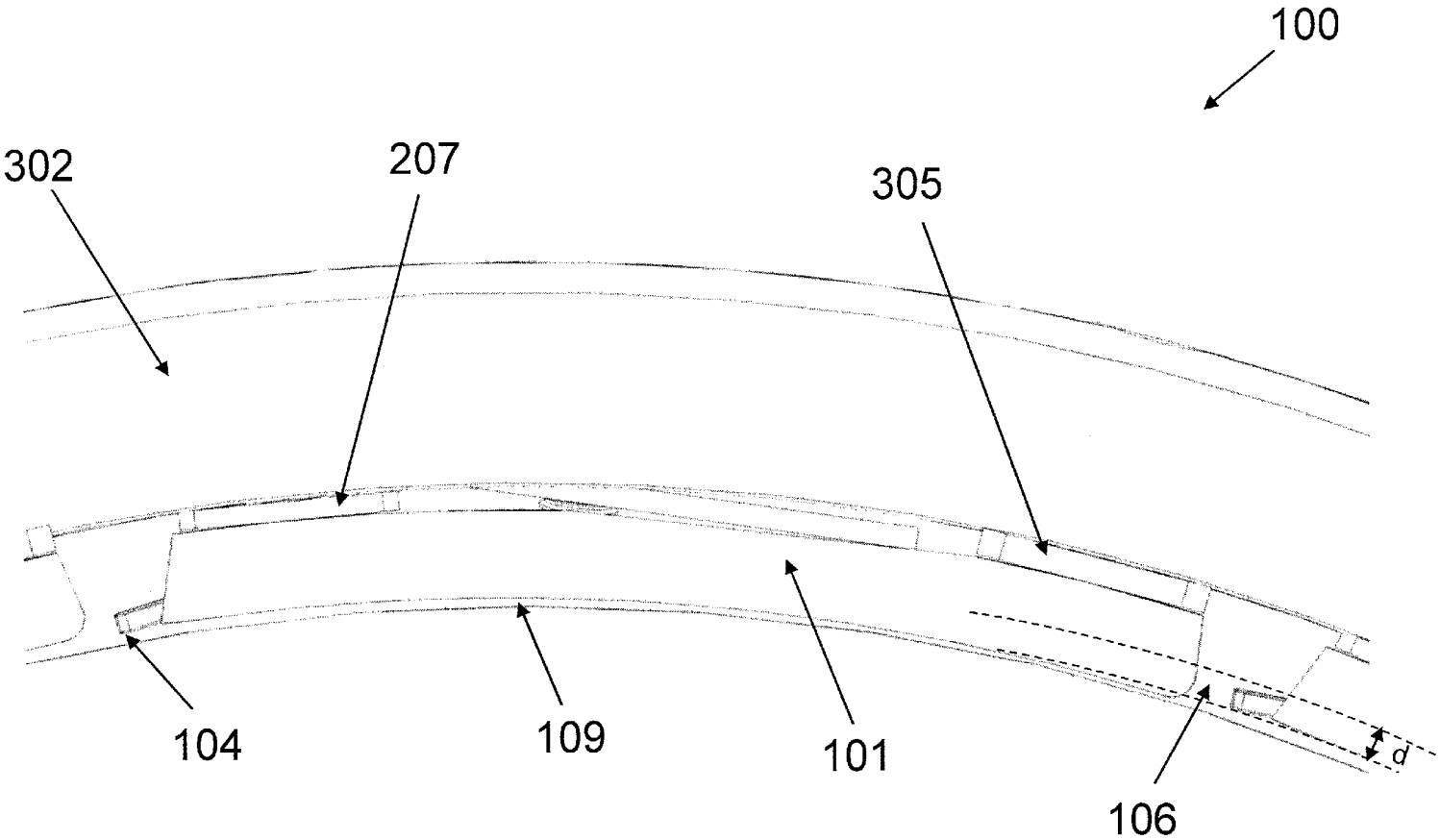

FIG. 1 shows an example of a cutting head 100 in the assembled state according to embodiments of the present invention. The cutting head assembly 100 may comprise a plurality of cutting stations 101 each provided at a front edge with a cutting element 104, 204. The cutting stations 101 may be separately (individually) mounted adjacent one another on the inside diameter of the rim structure 102 by a plurality of fixing elements 103. For example, the cutting stations 101 may be separately (individually) mounted on the rim structure by bolts arranged to cooperate with matching bores provided on the cutting stations 101 and the rim structure 102 such that a gap 106, the dimension of which is indicated by the distance (d) between the two dash lines as shown in FIGS. 5 to 7, may be formed between a front edge of the cutting element 104, 204 and a rear edge of an adjacent cutting station 101. Through this gap 106, the cut or reduced food products can exit the cutting head 100. The dimensions of the gap 106 may determine the slice thickness of the cutting head assembly 100, which determines the thickness of the cut or reduced food product. The cutting head assembly 100 may further comprise a first set of gap setting elements 105 arranged for adjusting the position of the rear edge of the cutting stations with respect to the front edge of the cutting element 104, 204, thereby adjusting the thickness settings of the cutting head assembly 100. According to embodiments of the present invention, the thickness of the cut or reduced food products may be adjusted by providing a first set of gap setting elements 105 at the rear edge of the cutting stations 101 so as to adjust the position of the rear edge of the cutting stations 101 from the rim structure. Adjusting the thickness setting of the cutting head according to embodiments of the present invention, may have as an advantage that the clearance of the front edge of the cutting element 104, 204 from the impeller 109 remains constant irrespective of the slice thickness settings of the cutting head assembly 100. Keeping the clearance of the cutting element 104, 204 constant of the from the impeller 109 and adjusting the slice thickness setting at the rear edge of the cutting stations 101, a much wider range of possible slice thickness settings can be handled by means of the same cutting head 100. This means that a user can handle a wider range of possible cuts with the same cutting head assembly than in the prior art, so needs to purchase or stock fewer cutting heads or parts thereof to be able to cover the desired range. Furthermore, adjusting the slice thickness setting of the cutting head assembly 100 from the rear edge, may have as an advantage over the prior art that damages to the cutting head assembly due to incorrectly positioning the cutting element 104, 204 with respect to the impeller can be avoided.

Figure 2:
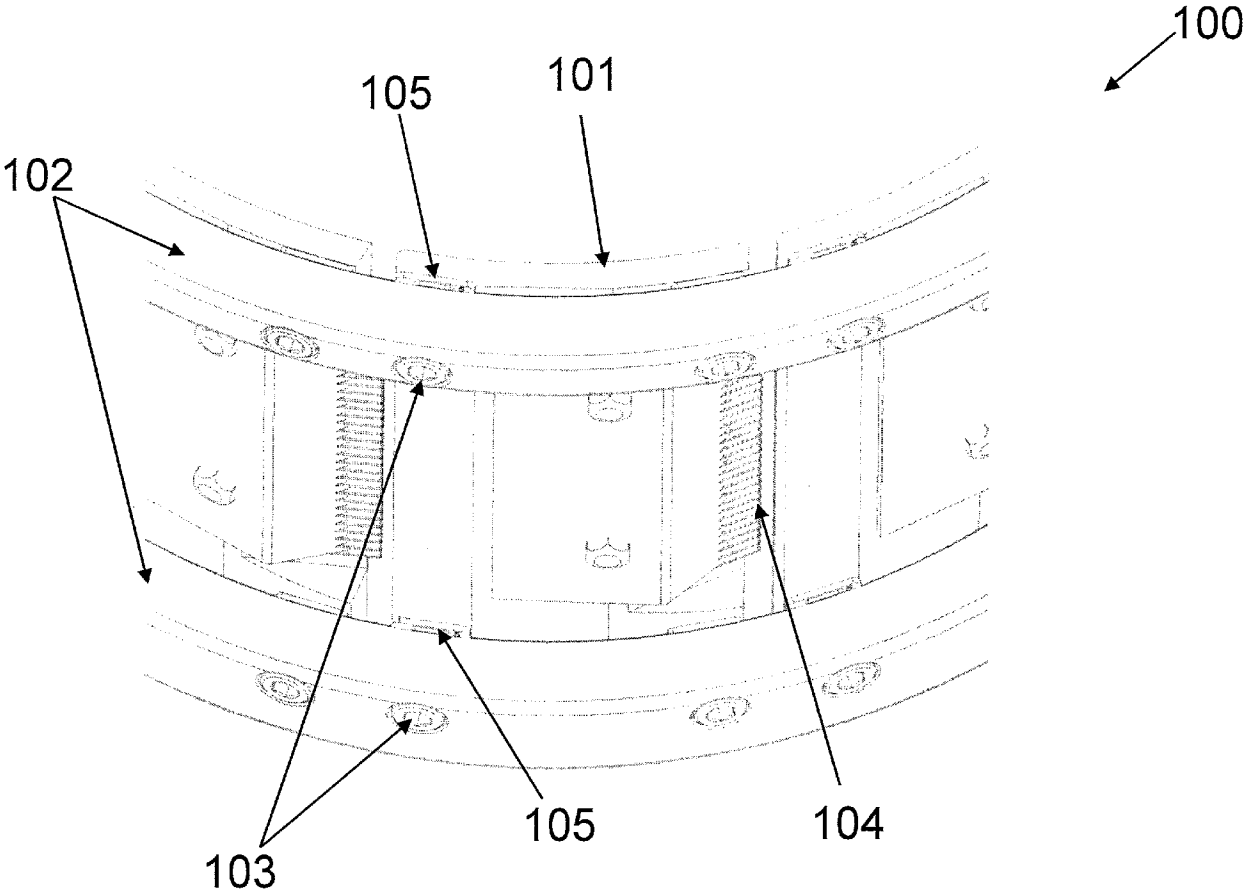
FIGS. 2 and 3 show different perspective views of a cutting head assembly according to embodiments of the present invention.
Figure 4:
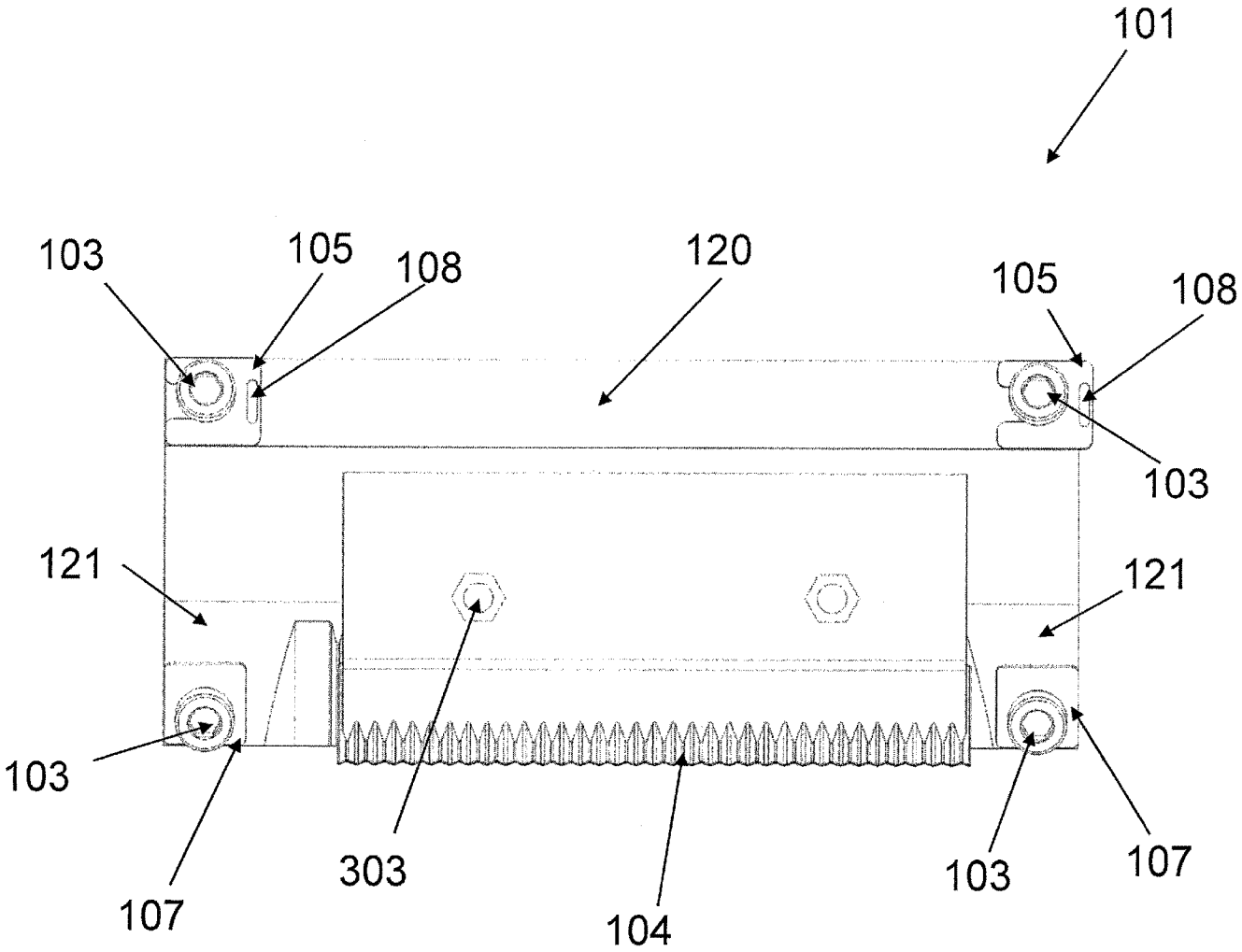
FIG. 4 shows a side view of a cutting station according to embodiments of the present invention.

According to embodiments of the present invention, the first set of gap setting elements 105 may be provided at predetermined locations between the rear edge of the cutting stations 101 and the rim structure 102 as shown in FIG. 2. The positioning of the first set of gap setting elements between the rim structure 102 and the rear edge of the cutting station 101 may offer the advantage that the shape of the first set of gap setting elements 105 may be independent from the shape of the inside surface of the cutting station 101, which is in contact with the food products rotating in the cutting head 100. This means that a user may use the same type of gap setting elements irrespective of the shape of the inside surface of the cutting station 101, thereby significantly reducing the number of spare parts required for setting the slice thickness setting of the cutting head 100. Moreover, the positioning the first set of gap setting elements 105 in between the cutting stations 101 and the rim structure 102 may further have as an advantage that the first set of gap setting elements 105 may be better secured into the desired position, thereby significantly reducing the chances of a gap setting element 105 becoming loose during operation of the cutting head 100. This arrangement may further ensure that even in the case where a gap setting element 105 becomes loose during operation of the cutting head 100, it will be directed to the outside of the cutting head assembly 100 rather on the inside where the food products are rotated. As a result, damage to the cutting elements 104, 204 or other parts of the cutting head assembly 100 due to the loose gap setting element 105 freely rotating in the cutting head assembly 100 can be avoided. As shown in FIGS. 2 and 4, the first set of gap setting elements 105 may be provided at the location of the fixing elements 103, both at the top and bottom, at the rear edge of the cutting stations 101. As a result, the first set of gap setting elements 105 may be secured into the desired position without the need for providing additional fixing elements 103, thereby ensuring that the cutting head 100 may be quickly assembled with the desired slice thickness settings for cutting or reducing the food products. Furthermore, the first set of gap setting elements 105 may be arranged to be exchangeable with gap setting elements 105 of different thicknesses, e.g. gap setting elements 205 and 305, for easily adjusting the position of the rear edge of the cutting stations 101 with respect the rim structure 102. The first set of gap setting elements 105 may be provided with an opening 108 for inserting a tool arranged for applying a pulling force, e.g. a screw driver, such that the first set of gap setting elements 105 may be removed without having to completely disassemble the cutting station 101 from the rim structure 102. According to embodiments of the present invention, by exchanging the first set of gap setting elements 105 with gap setting elements 105 of different thicknesses, e.g. gap setting elements 205 and 305, the position of the rear edge of the cutting stations 101 from the rim structure may be adjusted from 0.0 mm to around 50.0 mm, more preferably in the range from 0.0 mm to 20.0 mm, even more preferably in the range from 0.0 mm to 10.0 mm. As a result, different food products can be handled by means of the same cutting head assembly 100. For example, in the case where the food product is potatoes the adjustment range of the rear edge of the cutting stations 101 with respect to the rim structure 102 may be adjusted in the range from 0.0 mm to 10.0 mm. In a different example, when the food product is lettuce the rear edge of the cutting stations 101 with respect to the rim structure 102 may be adjusted in the range from 0.0 mm to 50.0 mm. To achieve this adjustment range, the first set of gap setting elements 105 may be provided with predetermined thicknesses. For example, the first set of gap setting elements 105 may be provided with a thickness of at least 0.01 mm, at most 10.0 mm, more preferably at most 1.0 mm, more preferably at most 0.1 mm, and even more preferably at most 0.05 mm. According to embodiments of the present invention, the position of the rear edge of the cutting stations 101 with respect to the rim structure 102 may be adjusted by using a combination of gap setting elements having different thicknesses.

Figure 3:
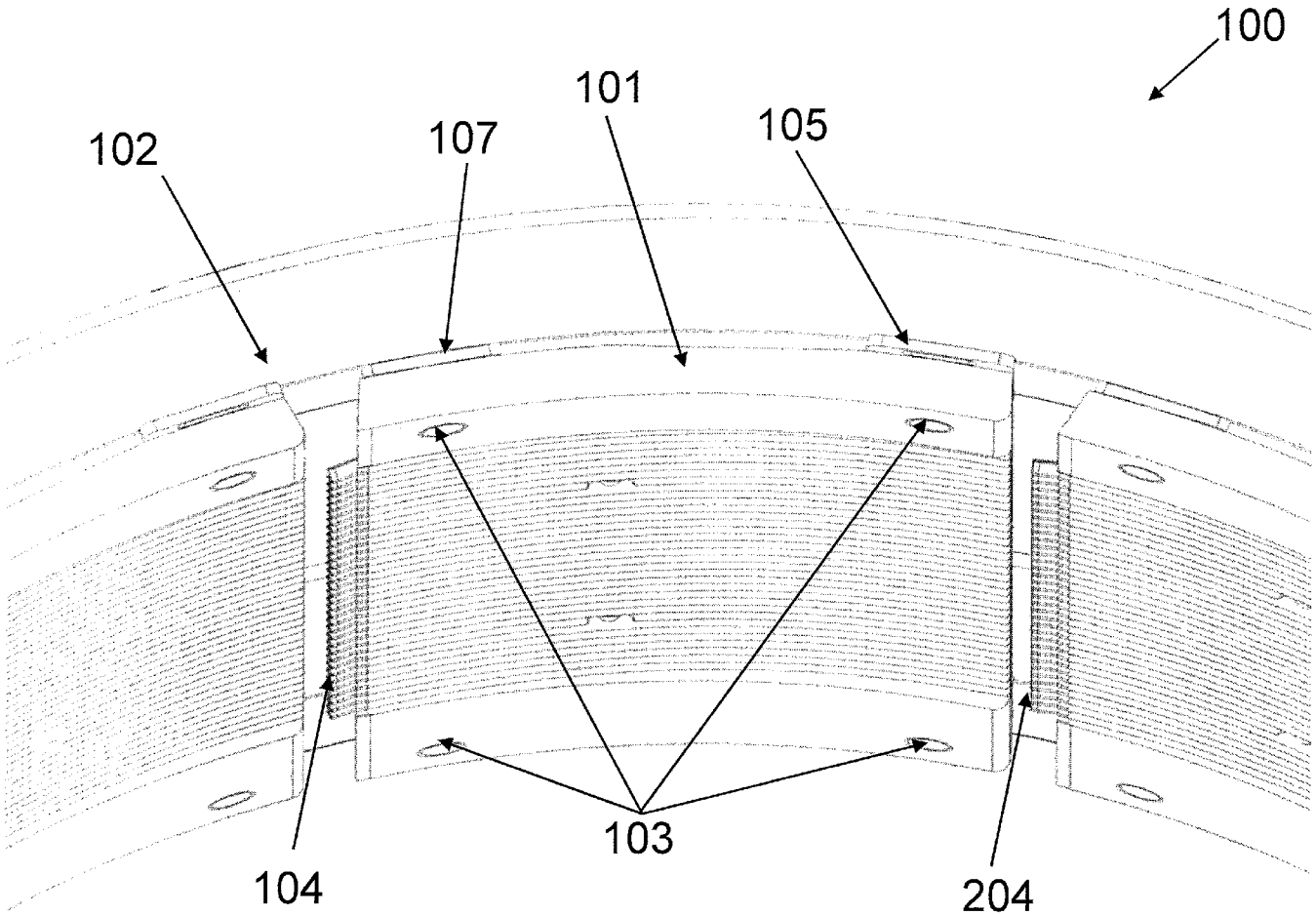
Figure 9:
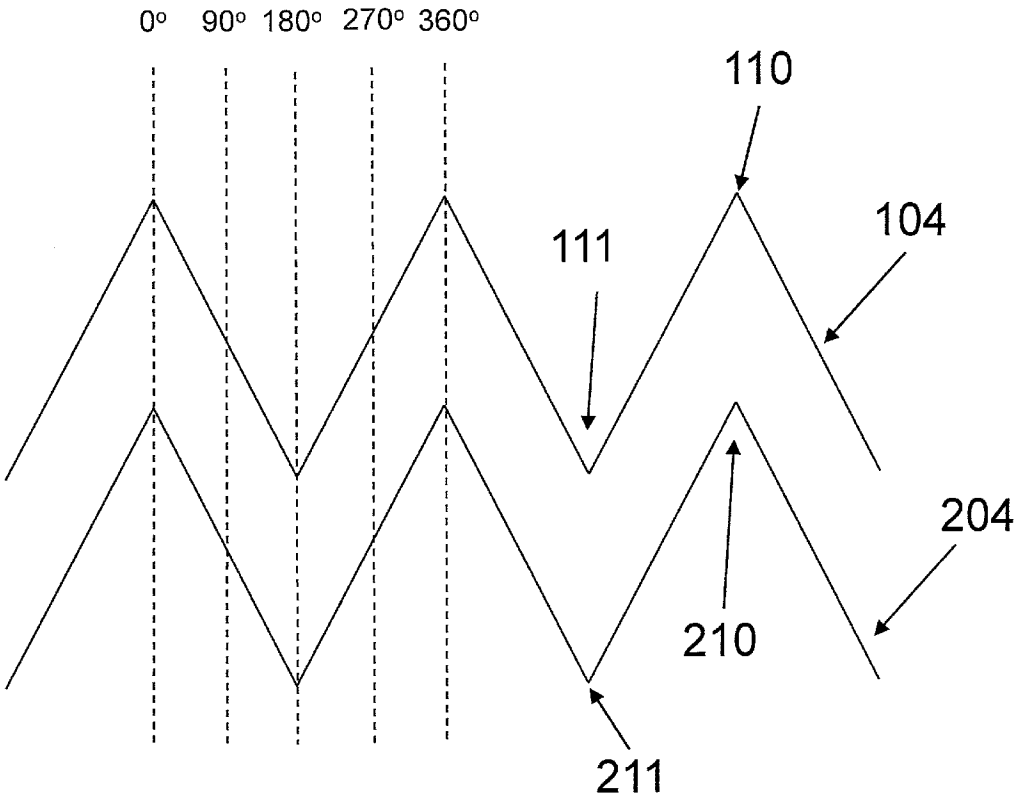
FIG. 9 shows an example of the phase shift between corrugated shaped cutting elements of adjacent cutting stations resulting from the mounting configuration of FIG. 8.

FIG. 3 shows an inside view of a cutting head assembly 100 according to embodiments of the present invention. The cutting head assembly 100 comprises cutting stations 101 provided on an inner surface with elongated grooves spanning the whole length of the cutting station 101. The elongated grooves may be used for providing relief from stones or other debris entering the cutting head assembly 100 along with the food products. Furthermore, the grooves may be used for guiding the food products along a predetermined path towards the front edge of the cutting element 104, 204 of adjacent cutting stations. For example in the case where the cutting stations 101 are provided with a corrugated shaped cutting element 104, 204, the elongated grooves may be arranged for aligning the food product to the peaks 110, 210 and valleys 111, 211 of the corrugated shaped cutting elements 104, 204, a shown in FIG. 9. As such, the peaks and valleys of the elongated grooves may also be aligned to the shape of the cutting element 104, 204 positioned on the same cutting station 102. For example, when the cutting station is provided with a corrugated shape cutting element 104, 204, the peaks and valleys of the elongated grooves may be aligned to the peaks 110, 210 and valleys 111, 211 of the corrugated shaped cutting element 104, 204.

According to embodiments of the present invention, the cutting head assembly 100 may be further provided with a second set of gap setting elements 107 at the front edge of the cutting stations 101, as shown in FIG. 3. The second set of gap setting elements 107 may be arranged for adjusting the position of the front edge of the cutting stations 101 from the rim structure 102 so as to compensate manufacturing tolerances, i.e. to correct any manufacturing errors occurred due to the accuracy limitations of the manufacturing tools used for manufacturing the cutting stations 101. These manufacturing errors may severely affect the alignment of the cutting element 104, 204 positioned at the front edge of the cutting stations 101, which may lead to poorly cut or reduced food products if not appropriately corrected. According to embodiments of the present invention, the position of the front edge of the cutting element 104, 204 may be arranged to remain constant irrespective of the slice thickness settings of the cutting head assembly 100. Therefore, the second set of gap setting elements 107 may be arranged so that they remain fixed in the desired locations while the cutting stations 101 are attached to the rim structure 102. According to embodiments of the present invention, each of the gap setting elements 107 of the second set may be provided with a predetermined thickness, which corresponds to the manufacturing tolerances detected. For example, in the case where the manufacturing error is greater at the bottom of the rear edge of the cutting station 101 than at the top, a second set of gap setting elements 107 having different thicknesses may be positioned at the top and bottom of the rear edge of the cutting station 101. In another example, when the manufacturing error detected is the same at both the top and bottom locations of the rear edge of the cutting stations 101, a second set of gap setting elements 107 of identical thicknesses may be used instead.

According to alternative embodiments of the present invention, the position of the front edge of the cutting station 101 with respect to the rim structure 102 may be adjusted by providing a set of adjustable calibrating elements at predetermined locations on the rim structure 102. For example, the adjustable calibrating elements may be screws arranged to be screwed into threaded bores on the rim structure such that an end of the screws, extending outwardly from the inside diameter of the rim structure, abuts the front edge of the cutting station 101. The distance between the end of the calibrating element and the inside diameter of the rim structure 102 determines the position of the front edge of the cutting station 101 with respect to the rim structure. In this alternative configuration, the position of the cutting station 101 may for example be adjusted by independently turning the screws provided, until the front edge of the cutting station 101 is positioned at the desired distance with respect to the rim structure 102. As a result, the position of the front edge of the cutting station may be easily adjusted to different distance from the rim structure. It should be noted that this alternative configuration for adjusting the position of the front edge of the cutting station 101 with respect to the rim structure 102 may also be applied for adjusting the position of the rear edge of the cutting station 101 with respect to the rim structure 102.

FIG. 4 shows an example of a cutting station 101 according to embodiments of the present invention. The cutting station may be provided at a front edge with a cutting element 104, e.g. a corrugated shaped cutting element 104. The cutting station may further comprise a first surface 120 located at the rear edge of the cutting station 101 and a second surface 121 located at the front edge of the cutting station 101. The first and second surfaces 120, 121 are arranged for facing the inside diameter of a rim structure 102 when the cutting station 101 is mounted on the rim structure 102. Fixing elements 303 may be further provided for securing the cutting element 104 on the front edge of the cutting station 101. Further fixing elements 103 may be provided, as previously mentioned, for mounting the cutting station 101 to the rim structure 102. The fixing elements 103 and 203 are arranged to cooperate with matching bores on the cutting stations 101 for securing the cutting elements 104 and further mounting the cutting station to the rim structure 102. According to embodiments of the present invention, the first surface 120 of the cutting station 101 may be arranged for receiving a first set of gap setting elements 105 arranged for adjusting the position of the rear edge of the cutting station 101 with respect to the rim structure 102 so as to adjust the position of the rear edge of the cutting station 101 with respect to the front edge of the cutting element 104 of adjacent cutting stations 101. As shown in FIG. 4, the first set of gap setting elements 105 may be provided at the locations of the fixing element 103 on the first surface 120. The first set of gap setting elements 105 may be provided with a recess so that the first set of gap setting elements 105 may be easily positioned at the fixing elements 103 locations even when the cutting station 101 is still mounted on the rim structure 102. Furthermore, the first set of gap setting elements 105 may be provided with an opening 108 for inserting a tool, e.g. screw driver, arranged for applying a pulling force on the gap setting elements 105 such that the gap setting elements 105 may be removed without the need for completely removing the cutting station 101 from the rim structure.

According to embodiments of the present invention, the second surface 121 of the cutting station 101 may be further arranged for receiving a second set of gap setting elements 107 for adjusting the position of the front edge of the cutting station with respect to the rim structure. The second set of gap setting elements 107 may be provided on the second surface 121 of the cutting station 101 at the location of fixing elements 103 on the second surface 121 for compensating the manufacturing tolerances, as previously discussed. The second set of gap setting elements 107 may have a different shape from the first set of gap setting elements 105. For example, the second set of gap setting elements may be provided with a hole, through which the fixing elements 103 may enter, while the first set of gap setting elements 105 may be provided with a recess. By providing a first and second set of gap setting elements 105, 107 having different shapes, the user may easily distinguish which gap setting elements 105, 107 correspond to the rear and front edges of the cutting station 101. Alternatively, the first and second sets may also comprise at least partly the same gap setting elements, i.e. gap setting elements which are usable at the front as well as the rear edges of the cutting stations. The second set of gap setting elements 107 may be arranged so that they remain fixed in the desired location while the cutting stations are attached to the rim structure 102.

According to embodiments of the present invention, the first and second surfaces 120 and 121 of the cutting station may have a curvature, the degree of which corresponds to the curvature of the inside diameter of the rim structure. As a result, the first and second 120 and 121 of the cutting station 101 may be arranged to perfectly fit on the rim structure such that a better mounting of the cutting stations can be achieved.

FIGS. 5 to 7 shows different examples of how the slice thickness settings of the cutting head may be adjusted according to embodiments of the present invention. FIG. 5 shows a top view of a cutting head assembly 100 according to embodiments of the present invention. The cutting head assembly 100 comprises a first set of gap setting elements 105 positioned at the rear edge of the cutting stations 101 and a second set of gap setting elements 107 positioned at the front edge of the cutting stations 101. The second set of gap setting elements 107 may be used for fixing the position of the front edge of the cutting element 104 with respect to the impeller. The first set of gap setting elements 105 may be used for positioning the rear edge of the cutting stations 101 at a predetermined distance from the rim structure 202. In this example, the first and second gap setting elements 105 and 107 are arranged to position the rear and front edges of the cutting station 101 at the same distance from the rim structure 202, such that a gap 106 of a predetermined dimensions, indicated by distance (d) between the two dashed lines, is formed between the rear edge of the cutting station 101 and the front edge of the cutting elements 104, 204 of adjacent cutting stations 101. In the case where the cutting station 101 is provided with elongated grooves on an inner surface and the cutting element 104, 204 of the adjacent cutting stations has a corrugated shape, the distance (d) indicating the dimension of the gap 106 may be measured between the valleys of the elongated groves of the cutting station 101 and the peaks 110, 210 of the corrugated shaped cutting elements 104, 204. In this example, a larger diameter rim structure 202 is provided compared to the rim structure 102 shown in FIGS. 1 to 3. Using a larger diameter rim structure 202 may result in the positioning of the cutting stations 101 at a greater distance with respect to the impeller 109. It has been found that using a larger diameter rim structure 202 may significantly increase the adjustment range of the slice thickness settings of the cutting head assembly 100 without the need for providing different cutting stations 101. For example, in the case of slicing lettuce, a larger diameter rim structure may be used for achieving an adjustment range from 0.0 mm to 50.0 mm without the need for providing different cutting stations than the ones used for example for cutting or reducing potatoes.

FIG. 6 shows how the slice thickness settings of the cutting head may be adjusted by exchanging the second set of gap setting elements 105 with a second set of gap setting elements 205 of different thickness. In this example, the distance of the front edge of the cutting element 104 with respect to the impeller remains constant with respect to that of FIG. 5. On the contrary, smaller thickness gap setting elements 205 are provided on the rear edge of the cutting station 101 resulting in the enlargement of the gap 106, which may lead to cut or reduced food products having larger thickness. Similarly to FIG. 5, the use of a larger diameter rim structure 202 may significantly increase the adjustment range of the slice thickness setting of the cutting head assembly 100, thereby enabling the cutting head 100 to handle different products without the need for changing the cutting stations 101.

FIG. 7 shows yet another example of a cutting head assembly 100 according to embodiments of the present invention. In this example, a smaller diameter rim structure 302 compared to the rim structure 202 shown in FIGS. 5 to 6 is provided. At the front edge of the cutting station a second set of gap setting elements 207 is provided for setting the distance of the front edge of the cutting elements 104, 204 from the impeller at the same level to that of FIGS. 5 and 6. Due to the smaller diameter rim structure 302, the thickness of the second set of gap setting elements 207 is smaller than the thickness of the second set of gap setting elements 107 shown in FIGS. 5 and 6. The rear edge of the cutting station 101 is provided with a first set of gap setting elements 305 having a slightly larger thickness compared to the thickness of the second set of gap setting element 207. As a result, a gap 106 having smaller dimensions is formed, leading cut or reduced food products having a smaller thickness.

Figure 8:
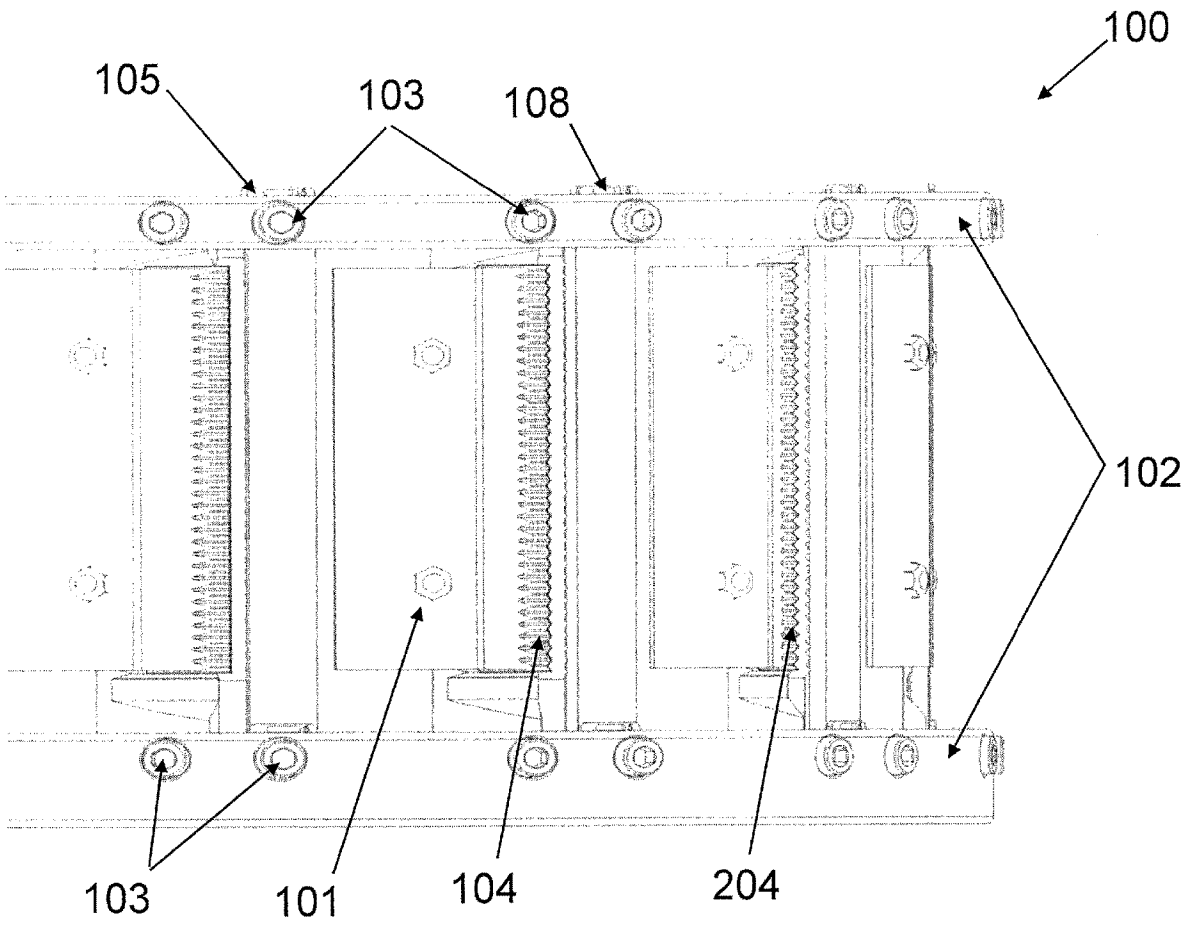
FIG. 8 shows a side view of a cutting head assembly according to embodiments of the present invention with the cutting stations mounted in alignment with one another.
Figure 10:
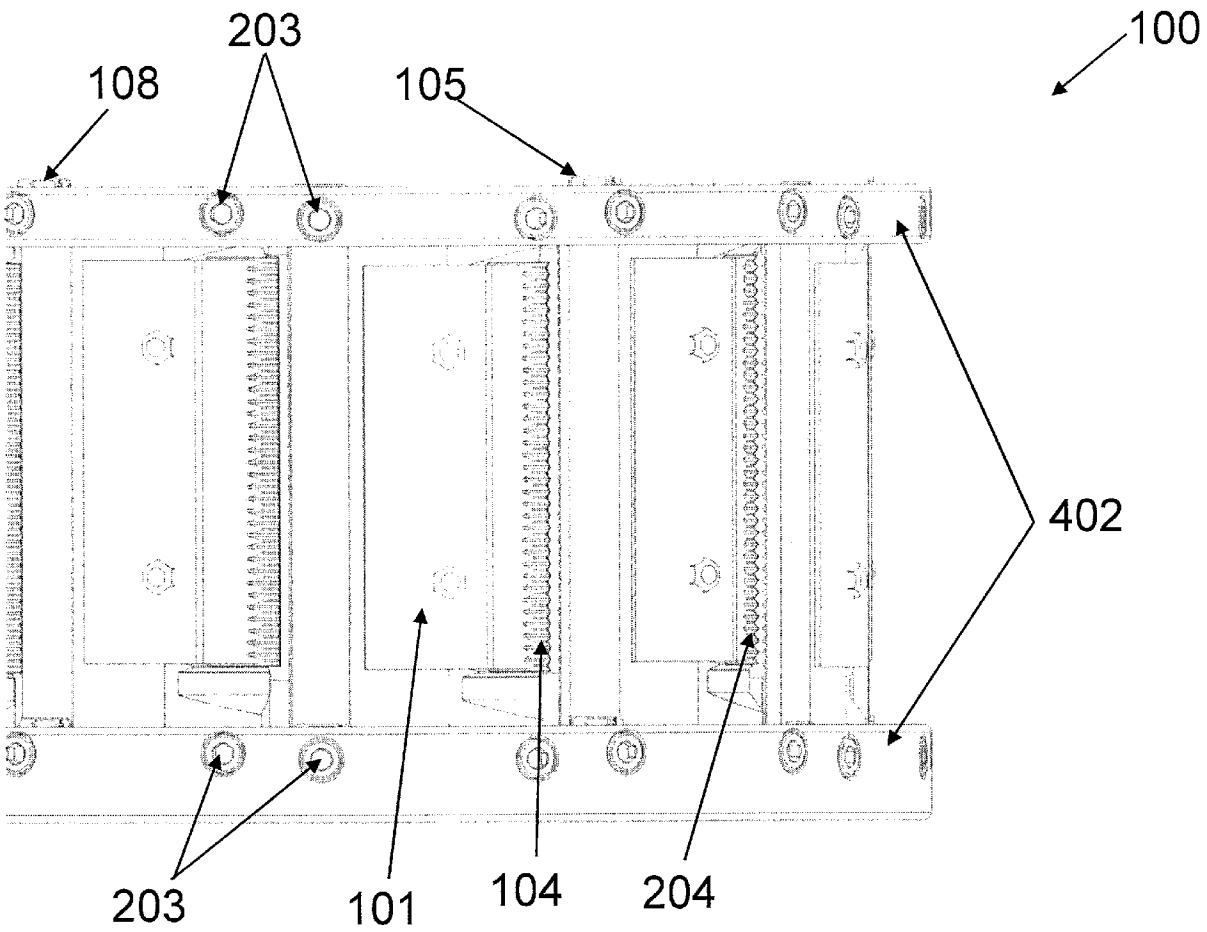
FIG. 10 shows a side view of a cutting head assembly according to embodiments of the present invention with adjacent cutting stations mounted at different levels.
Figure 11:
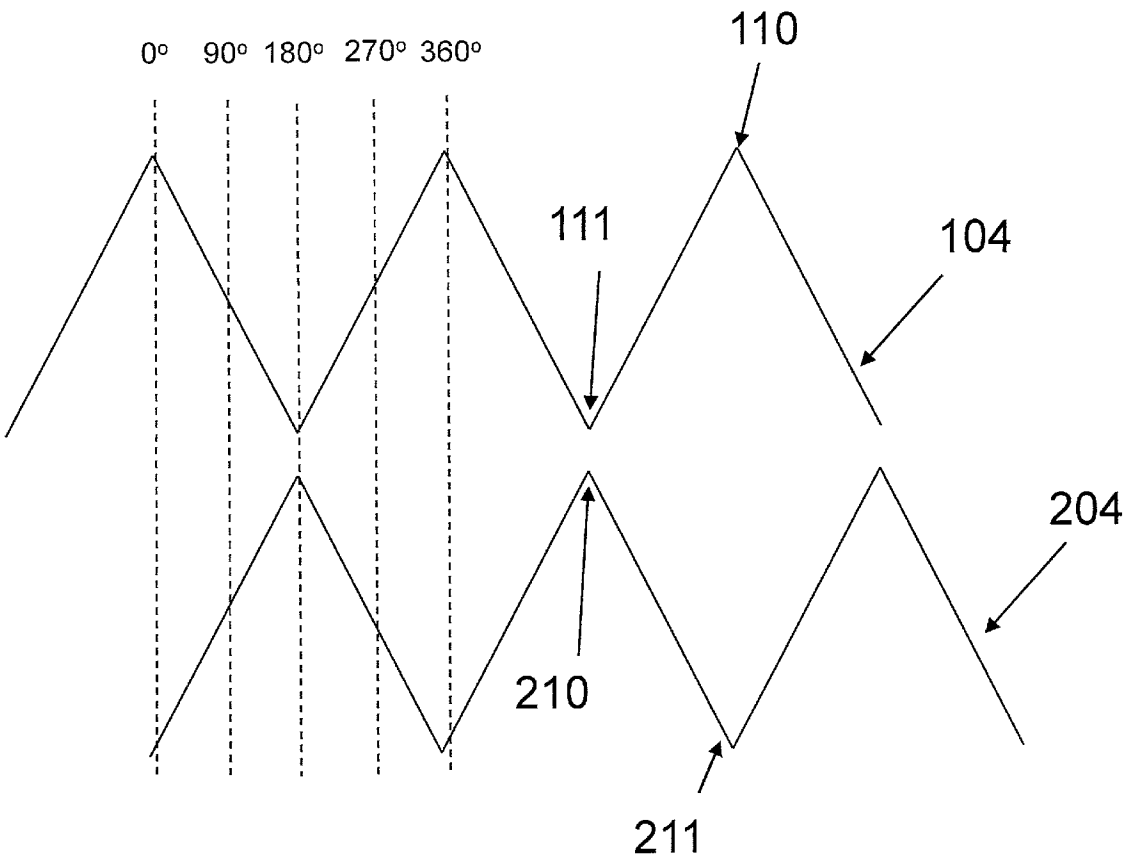
FIGS. 11 and 12 show an example of the phase shift between corrugated shaped cutting elements resulting from the mounting configuration of FIG. 9
Figure 12:
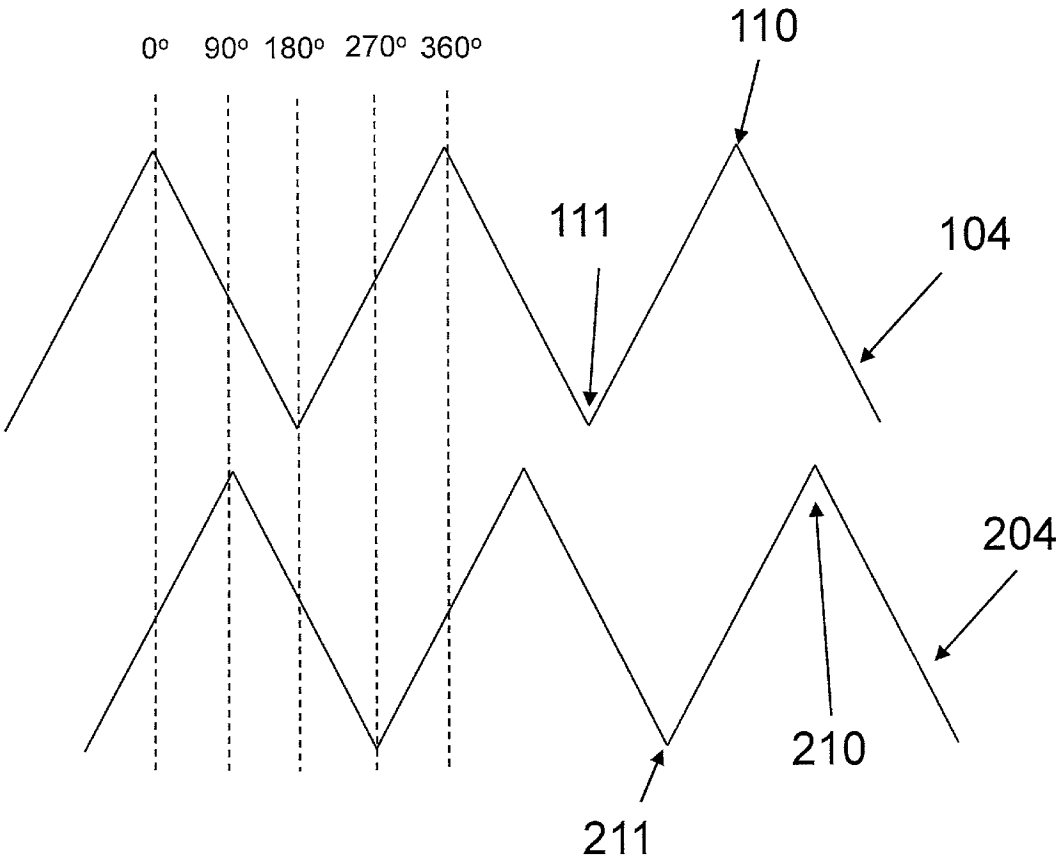

FIG. 8 shows a side view of a cutting head assembly 100 according to embodiments of the present invention. In this example, the cutting head assembly is provided with a rim structure 102 having a number of bores, at the location of the fixing elements 103. The bores are provided at the same level, so that when the cutting stations 101 are mounted on the rim structure 102 the cutting elements 104, 204 of adjacent stations are in alignment, e.g. phase shifted by 0° degrees. For example, in the case where the cutting elements 104, 204 have a corrugated shape, the peaks 110, 210 and valleys 111, 211 of the cutting elements 104, 204 provided on adjacent cutting stations will be phase shifted by 0°, a shown in FIG. 9. This configuration may be used for example with corrugated or flat shaped cutting elements 104, 204 to produce sliced food products having an identical shape on both sides FIG. 10 shows a further side view of a cutting head assembly 100 according to embodiments of the present invention. In this example, a rim structure 402 may be provided having a number of bores, at the location of the fixing elements 303, positioned at the different levels. As a result, the cutting stations 101 can be mounted on the rim structure 402 in different configurations. For example, the location of the bores may allow for alternate cutting stations 101 to be positioned at a different level with respect to adjacent cutting stations 101. This may result, in the cutting elements 104, 204 to be phase shifted. For example, in the case of corrugated shaped cutting elements 104, 204, the peaks 110, 210 and valleys 111, 211 of the cutting elements 104, 204 of adjacent cutting stations 101 may be phase shifted between 0° and 180° This is shown schematically in FIGS. 11 and 12, where the peaks 110, 210 and valleys 111, 211 of the corrugated shaped cutting elements 104, 204 provided on adjacent cutting stations are phase shifted by 180° and 90° degrees respectively. This arrangement of mounting the cutting stations 101 may be used for example for shredding food products or for producing sliced food products having a different shape on each side.

According to embodiments of the present invention, the cutting head assembly 100 may be fitted to a centrifugal cutting apparatus for cutting food products, such for example the one known from the US patent application published as US2014030396, which is completely incorporated herein by reference.

The invention claimed is:

1. A cutting head assembly for a centrifugal cutting apparatus, the cutting head assembly comprising:

a rim structure;

a plurality of cutting stations each provided at a front edge with a cutting element for cutting or reducing food products, the cutting stations being separately mounted adjacent one another on the rim structure such that a gap is formed between a cutting edge of the cutting element and a rear edge of an adjacent cutting station through which the cut or reduced food products can exit the cutting head, each cutting station having a first surface located at the rear edge of the cutting station and a second surface located at the front edge of the cutting station, the first and second surfaces being arranged for facing an inside diameter of the rim structure when the cutting station is mounted on the cutting head assembly;

fixing elements arranged for securing the cutting stations to the rim structure at fixed locations; and a first set of gap setting elements arranged for adjusting the position of the rear edge of the cutting stations with respect to the cutting edge of the cutting elements of adjacent cutting stations by adjusting the position of the rear edge of the cutting stations with respect to the rim structure;

wherein the first set of gap setting elements comprise exchangeable gap setting elements of different thicknesses for adjusting the position of the rear edge of the cutting stations with respect to the rim structure; and wherein the first surface of each cutting station forms a predetermined location for receiving at least one gap setting element of said first set of gap setting elements, such that when the cutting station is mounted on the cutting head assembly said at least one gap setting element is securely held between the first surface of the cutting station and an opposing surface on the inside diameter of the rim structure.

2. The cutting head assembly according to claim 1, wherein the gap setting elements of said first set of gap setting elements are mounted at the fixed locations of the fixing elements at the rear edge of the cutting stations.

3. The cutting head assembly according to claim 1, wherein the first set of gap setting elements are arranged for adjusting the position of the rear edges of the cutting stations from the rim structure in the range from 0.0 mm to 50.0 mm, more preferably in the range from 0.0 mm to 20.0 mm, even more preferably in the range from 0.0 mm to 10.0 mm.

4. The cutting head assembly according to claim 1, wherein the thicknesses of the first set of gap setting elements vary in increments of at least 0.01 mm, at most 10.0 mm, more preferably at most 1.0 mm, more preferably at most 0.1 mm, and even more preferably at most 0.05 mm.

5. The cutting head assembly according to claim 1, comprising a second set of gap setting elements arranged for setting the position of the front edge of the cutting stations with respect to the rim structure.

6. The cutting head assembly of claim 5, wherein the second set of gap setting elements are arranged to be fixed at the fixed locations of the fixing elements at the front edge of the cutting stations.

7. The cutting head assembly according to claim 6, wherein the second set of gap setting elements have predetermined thicknesses corresponding to the manufacturing tolerances of the cutting stations.

8. The cutting head assembly according to claim 6, wherein the first set of gap setting elements arranged for setting the position of the rear edges of the cutting stations have a different shape from the second set of gap setting elements arranged for setting the position of the front edges of the cutting stations.

9. The cutting head assembly according to claim 1, wherein the cutting stations are provided with elongated grooves on the inside of the cutting head assembly.

10. The cutting head assembly according to claim 9, wherein the elongated grooves span more than half the length of the cutting stations.

11. The cutting head assembly according to claim 1, wherein the rim structure is arranged for functioning as a sizing element for defining the size of the cutting head.

12. The cutting head assembly according to claim 1, wherein the fixing elements comprise bolts arranged for cooperating with matching bores provided on the cutting stations and the rim structure.

13. A centrifugal cutting apparatus comprising a cutting head assembly comprising:

a rim structure;

a plurality of cutting stations each provided at a front edge with a cutting element for cutting or reducing food products, the cutting stations being separately mounted adjacent one another on the rim structure such that a gap is formed between a cutting edge of the cutting element and a rear edge of an adjacent cutting station through which the cut or reduced food products can exit the cutting head, each cutting station having a first surface located at the rear edge of the cutting station and a second surface located at the front edge of the cutting station, the first and second surfaces being arranged for facing an inside diameter of the rim structure when the cutting station is mounted on the cutting head assembly;

fixing elements arranged for securing the cutting stations to the rim structure at fixed locations; and a first set of gap setting elements arranged for adjusting the position of the rear edge of the cutting stations with respect to the cutting edge of the cutting elements of adjacent cutting stations by adjusting the position of the rear edge of the cutting stations with respect to the rim structure;

wherein the first set of gap setting elements comprise exchangeable gap setting elements of different thicknesses for adjusting the position of the rear edge of the cutting stations with respect to the rim structure; and wherein the first surface of each cutting station forms a predetermined location for receiving at least one gap setting element of said first set of gap setting elements, such that when the cutting station is mounted on the cutting head assembly said at least one gap setting element is securely held between the first surface of the cutting station and an opposing surface on the inside diameter of the rim structure.

14. An assembly comprising:

a cutting station for a cutting head assembly of a centrifugal cutting apparatus, the cutting station comprising:

means for receiving a cutting element positioned at a front edge of the cutting station for cutting or reducing food products, at least one first surface located at the rear edge of the cutting station and at least one second surface located at the front edge of the cutting station, the first and second surfaces being arranged for facing an inside diameter of a rim structure when the cutting station is mounted on the cutting head assembly, the cutting station being arranged to be separately mounted adjacent other cutting stations on the rim structure such that a gap is formed between a cutting edge of the cutting element and a rear edge of an adjacent cutting station through which the cut or reduced food products can exit the cutting head; and a first set of gap setting elements, comprising exchangeable gap setting elements of different thicknesses, arranged for adjusting the position of the rear edge of the cutting station with respect to the rim structure so as to adjust the position of the rear edge of the cutting station with respect to the cutting edge of the cutting element of the adjacent cutting station;

wherein each first surface of the cutting station forms a predetermined location for receiving at least one gap setting element of said first set, such that when the cutting station is mounted on the cutting head assembly, said at least one gap setting element is securely held between the respective first surface and an opposing surface on the inside diameter of the rim structure.

* * * * *